US010717019B2

(12) United States Patent
Eshet et al.

(10) Patent No.: US 10,717,019 B2
(45) Date of Patent: Jul. 21, 2020

(54) FLEXIBLE CONSTRUCTION UNIT, KIT, AND METHOD FOR CONSTRUCTING A STRUCTURE

(71) Applicant: TOYISH LABS INC., Brooklyn, NY (US)

(72) Inventors: Assaf Eshet, Brooklyn, NY (US); Yaron Barlev, Closter, NJ (US)

(73) Assignee: Toyish Labs Inc., Brooklyn, NY (US)

( * ) Notice: Subject to any disclaimer, the term of this patent is extended or adjusted under 35 U.S.C. 154(b) by 0 days.

(21) Appl. No.: 16/296,543

(22) Filed: Mar. 8, 2019

(65) Prior Publication Data

US 2019/0275440 A1 Sep. 12, 2019

Related U.S. Application Data

(60) Provisional application No. 62/640,769, filed on Mar. 9, 2018.

(51) Int. Cl.
*A63H 33/08* (2006.01)
*A63H 33/04* (2006.01)

(52) U.S. Cl.
CPC ..... *A63H 33/046* (2013.01); *A63H 33/042* (2013.01); *A63H 33/084* (2013.01)

(58) Field of Classification Search
CPC ... A63H 33/046; A63H 33/042; A63H 33/084
USPC ..... 446/92, 107, 114
See application file for complete search history.

(56) References Cited

U.S. PATENT DOCUMENTS 3,998,004 A * 12/1976 Ehrlich ..... A63H 33/046 446/92
4,294,036 A * 10/1981 Wion ..... A63H 3/46 446/135
5,362,271 A * 11/1994 Butt ..... A63H 3/36 446/129
7,581,547 B2 * 9/2009 Pena ..... A45D 8/00 132/275
7,641,534 B2 * 1/2010 Holman ..... A63H 33/046 446/85
8,292,687 B2 * 10/2012 Tremblay ..... A63H 33/046 446/92
8,850,683 B2 10/2014 Haughey et al.
9,914,067 B2 3/2018 Sufer et al.
(Continued)

FOREIGN PATENT DOCUMENTS

DE 102004005386 A1 * 8/2005 ..... A63H 33/046

*Primary Examiner* — Vishu K Mendiratta
(74) *Attorney, Agent, or Firm* — Jacob M. Ward; Ward Law Office LLC

(57) ABSTRACT

A construction unit may have a main body formed from a flexible material. The main body may have a first side and a second side. The construction unit may have a plurality of magnetic connectors attached to the main body. A kit for construction of a structure may have a plurality of construction units, at least one flexible link, at least one active unit, and at least one control unit. A method of making a structure includes a first step of providing a plurality of construction units. There is second step of connecting at least one of the magnetic connectors of a first one of the construction units with at least one of another one of the magnetic connectors of the first one of the construction units, and at least one of the magnetic connectors of a second one of the construction units, whereby the structure is formed.

15 Claims, 9 Drawing Sheets

(56) References Cited

U.S. PATENT DOCUMENTS

| | | | | |
|---|---|---|---|---|
| 2014/0227939 | A1* | 8/2014 | Kim | A63H 33/046<br>446/124 |
| 2015/0325949 | A1 | 11/2015 | Wei | |
| 2016/0074766 | A1 | 3/2016 | Choi | |
| 2017/0340979 | A1* | 11/2017 | Sufer | A63H 33/084 |

* cited by examiner

FLEXIBLE CONSTRUCTION UNIT, KIT, AND METHOD FOR CONSTRUCTING A STRUCTURE

CROSS-REFERENCE TO RELATED APPLICATIONS

This application claims the benefit of U.S. Provisional Application Ser. No. 62/640,769, filed on Mar. 9, 2018. The entire disclosure of the above application is hereby incorporated herein by reference.

FIELD

The present disclosure relates to systems and methods for constructing structure and, more specifically, to a construction unit formed from flexible sheets.

BACKGROUND

Children are often captivated by toys that can be assembled. The act of creation helps a child build spatial awareness and can provide many hours of entertainment.

A variety of toys that require assembly are known in the art. However, many known toy construction pieces are rigid and non-flexible, and can often be difficult to connect and disconnect, especially for younger children.

Often, these known toys are composed of many pieces that are able to be joined together, for example, by using friction fit fasteners, glue, or magnets. Certain toys are described in U.S. Patent Application Serial No. 2016/0074766 to So Young Choi, and U.S. Pat. No. 8,850,683 to Christopher Haughey et al., which each teach block toys with magnets embedded inside so that the blocks are easily combined by means of magnetism when placed proximately to each other. Another known toy is described in U.S. Pat. No. 9,914,067 to Sufer et al., and involves a flexible building segment with ribs sections and embedded magnets.

There is a continuing need for a construction unit that can be assembled in various ways to easily form three-dimensional shapes and structures. Desirably, the components of the construction unit are flexible and easily connected and disconnected. Most desirably, the construction units are entertaining for children and adults and usable as toys.

SUMMARY

In concordance with the instant disclosure, a construction unit that can be assembled in various ways to easily form three-dimensional shapes and structures, and which has components that are flexible and easily connected and disconnected, and which are entertaining for children and adults and usable as toys, has been surprisingly discovered.

In one embodiment, a construction unit may have a main body. The main body may be formed from at least one sheet of a flexible material. The main body may have a first side and a second side. The construction unit may have a plurality of magnetic connectors attached to the main body.

In another embodiment, a kit for construction of a structure may have a plurality of the construction units. The plurality of construction units may include a variety of shapes. The kit may further include an active unit and a control unit that are configured to be in electronic communication with each other. The active unit and control unit may be placed in electronic communication via a flexible link.

In a further embodiment, a method of making a structure includes a first step of providing a plurality of the construction units. The method includes a second step of connecting at least one of the magnetic connectors of a first one of the construction units with at least one of another one of the magnetic connectors of the first one of the construction units, and at least one of the magnetic connectors of a second one of the construction units. The structure is thereby formed.

In an exemplary embodiment, the construction unit is a toy. The toy may include a flexible sheet with a plurality of magnets embedded within the flexible material of the sheet. The magnets may be on the periphery of the flexible material.

The magnets of a first flexible sheet can be removably adhered to the magnets of a second flexible sheet. In other words, the connecting of the first and second sheets does not need to be permanent, and the first and second flexible sheets can instead be connected by magnets in a first arrangement, and then separate and reassembled into a second arrangement, as desired. The first and second sheets may be configured to form a three-dimensional structure.

The toy may include at least one module that is removably adhered by a magnet on the flexible sheet, or to a magnet of a three-dimensional structure formed from one or more of the flexible sheets.

In particular, the present disclosure relates to embedding magnets to papers or any other flexible sheets, in order to construct three-dimensional structures. While there may be other common ways to connect pieces of sheets together such as stapling, gluing, masking taping, etc., all these ways do not have an easy way to disconnect.

For some purposes, it is vital to have an easy way to connect and disconnect the sheets. When making three-dimensional shapes with multiple sheets there is no easy solution of connecting and then disconnecting these sheets from each other. The present disclosure seeks to provide a solution to these problems by providing magnets embedded in a flexible sheet that allow the sheet to be connected to other sheets easily and then disconnected from each other just as easily. The magnets embedded in the flexible sheet allow the sheet to be connected to itself to form a three-dimensional shape. One sheet can in fact form more than one three-dimensional shape, as desired. Moreover, a single sheet can be connected to other sheets in various ways to form three-dimensional shapes and structures.

A special device may be used to embed a magnet within a sheet, or otherwise attach the magnet to the sheet, in a way that the magnet is permanently fixed to the sheet. More than one magnet can be embedded within the same sheet. Thus, these magnets can be attracted to each other and form a three-dimensional shape out of the sheet. Also, the sheet can be connected in various ways to other sheets to form three-dimensional structures.

As a technological addition to the sheet, there are various magnet modules (e.g., electronic modules that also contain a power source such as a battery) that each function once it is magnetized to the embedded magnets on the sheet. The module may be a plastic box that contains electronic parts and has either input sensors such as proximity/light sensors, orientation sensors, sound sensors, or output components with functional capabilities such as sound, light, and/or movement. The module can be connected to the internet cloud and/or a mobile remote device, for example, through use of wireless transmissions such as Bluetooth®. The modules can also be activated from a remove device such as a smart phone such as an iPhone®, or a tablet computer such as an iPad®. Other suitable types of sensors and electronic parts may also be used, as desired. Once this module is assembled with the three-dimensional structures, it gives the three-dimensional structures an added technological feature such as movement of the three-dimensional sheet structure or a light that is glowing through the sheets, where the sheets are translucent or transparent.

It should also be appreciated that the sheets may have holes or a hole pattern (e.g., for light to come out through, or to be used as further connectors). The holes may be used in addition to or separate from the translucency or transparency of the sheets for light distribution, as desired.

The magnets may be placed on the corners of the flexible sheet. In particular, the magnets may be disc magnets. Their size will be selected depending on the kind of sheet that is being used. If a less flexible sheet is used (e.g., a thick polypropylene), then a larger magnet may be needed. If a more flexible sheet is used (e.g., a normal piece of paper), then a smaller magnet may be needed.

These magnets are embedded to the sheet in various ways the manufacturer chooses. They can be glued, laminated, contained in a plastic chamber, layered between two sheets, or any other way as long as the magnets are embedded to the sheet in a way that the magnets are irremovably secured to the sheet.

Two sheets with embedded magnets can be attracted to each other. Another option is to magnetize the sheet to itself to form a three-dimensional shape such as a cylindrical shape. Two or more sheets can be attracted to each other by magnets to form a three-dimensional structure such as a tower. By connecting a few sheets together in various ways, one can construct many different objects such as animals, robots, vehicles, and so on. An example of such a construction is a fort.

By adding a magnet module, e.g., the size of 1 cubic cm (or anything up to 1000 cubic cm), as non-limiting examples, to any construction, the outcome is a dynamic magnetic flexible sheet. One example of a suitable module is disclosed in U.S. Patent Application Publication No. 2015/0325949 to Zhengpeng Wei, the entire disclosure of which is incorporated herein by reference. A skilled artisan may also select other suitable magnetic modules, as desired.

When the magnetic module is connected to a magnet and thus turns itself "on," it transforms the construction to a dynamic construction. The dynamic construction may include movement like, for example, the spinning of blades of a windmill or a spinning mobile. In alternative embodiments, the magnetic module may act as a connection point instead of a switch. The module can be connected to the internet, cloud and/or a mobile remote device, or may otherwise be networked as understood by one of ordinary skill in the art.

Although described primarily herein as a "toy," it should be understood that the novel structure of the present disclosure may also have other applications, including for decorations and also as functional structures, as non-limiting examples. All such other uses of the novel structure are contemplated and considered to be encompassed within the scope of the present disclosure.

In a particular embodiment, a toy may include a flexible sheet that is capable forming a variety of shapes and structures. The flexible sheet may be folded in such a way to create three-dimensional structures.

The flexible sheets may be removably adhered to themselves or other sheets using magnets. The flexible sheets may be made of a paper, plastic, metal, rubber, silicone, or any other material chosen by a skilled artisan. Moreover, the magnets may be neodymium iron boron (NdFeB), samarium cobalt (SmCo), alnico, ceramic, ferrite or any other type of magnet chosen by a skilled artisan. For example, the magnets may be disc magnets.

Although being generally rectangular in shape, the flexible sheets may be a variety of shapes, including but not limited to circles, squares, triangles, hexagons or any type of polygon, as desired.

The magnets are shown primarily on the outer perimeter of the sheets. However, it should be appreciated that the magnets may be placed in any suitable location or orientation on the flexible sheet by a skilled artisan.

Additionally, although the use of magnets may be preferred, it should be understood that the sheets may also be removably adhered in other ways, including snaps, buttons, latches, or any other suitable mechanism selected by one of skill in the art, and that such fasteners are also considered within the scope of the present disclosure.

A special device may also be used to embed the magnet in the flexible sheet, whereby the magnet is fixed to the sheet. More than one magnet may be affixed to the same sheet. In other examples, the flexible sheet may be formed by layering together two sheets, and thus locking magnets in between the layers forming the sheet. Consequentially, one magnet may be adhered to an opposing magnet on the same sheet, forming a three-dimensional shape. These magnets may be fixed to the sheet in various ways, including but not limited to glue, lamination, heat fixation, or any other mechanism chosen by a skilled artisan. Furthermore, multiple sheets with embedded magnets may be removably adhered to each other.

The magnets may be placed on the periphery of the flexible sheet. Additionally, the size of the magnet depends on the type of sheet material. For example, thicker sheet material may require a larger or stronger magnet, while the more flexible sheet material may require a smaller or less powerful magnet.

Two or more sheets may be magnetized to each other to form a three-dimensional structure, such as a tower. By adhering the magnets disposed in multiple sheets together in various ways, one can construct many different objects such as animals, robots, vehicles, or any other structure chosen by a skilled artisan. As an example, there is a fort composed of sheets that are removable using the magnets.

Additionally, a user may attach a module to the flexible sheets. The module has a magnet that is configured to adhere to the magnets affixed to the flexible sheet. In certain embodiments the magnet attached to the module may be 1 cubic cm, and up to 1000 cubic cm.

The module may produce sound, light, or movement. For example, the module may include at least one of a speaker, an LED light, and a motor. The module may also have a power source such as a battery. The module may also include a microprocessor and a memory and be configured to execute certain programmable actions.

The module may also be attached to the sheets in a three-dimensional structure. The three-dimensional structure, along with the modules may provide movement of the three-dimensional sheet structure.

Moreover, the module may have a transceiver and be configured to communicate wirelessly with a variety of user devices, such as a personal computer or a mobile device. The module may use Bluetooth, WIFI, or another suitable form of wireless communication, as desired. Furthermore, there may be a plurality of modules that are configured work together. The plurality of modules may be attached to the sheet to form a robot, drone, or any other toy as chosen by a skilled artisan. For example, the modules may be arms, legs, and a head of a robot, wheels that are controlled wirelessly to form a remote-controlled car, or arms and legs to form a dancing doll. In a further example, a module with a rotating spinning arm is attached to the fort.

The module may also only "turn on" when adhered to another magnet. When the module is magnetized it activates, causing the module to activate an input sensor or light up, produce sound or cause movement.

Advantageously, the toy as described hereinabove can be assembled in various ways to easily form three-dimensional shapes and structures. It should be understood that the above-described toy has components in the form of the flexible sheets that are flexible and easily connected and disconnected, in operation.

DRAWINGS

The above, as well as other advantages of the present disclosure, will become readily apparent to those skilled in the art from the following detailed description, particularly when considered in the light of the drawings described hereafter.

Figure 16:
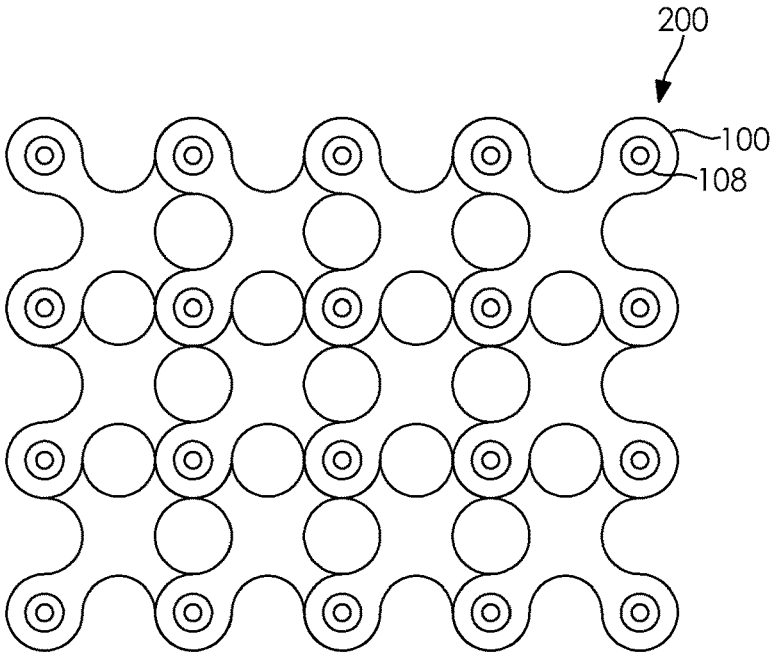
FIG. 16 illustrates a plurality of the construction units shown in FIG. 1, depicted in operation and being connected to one another in a first step.
Figure 17:
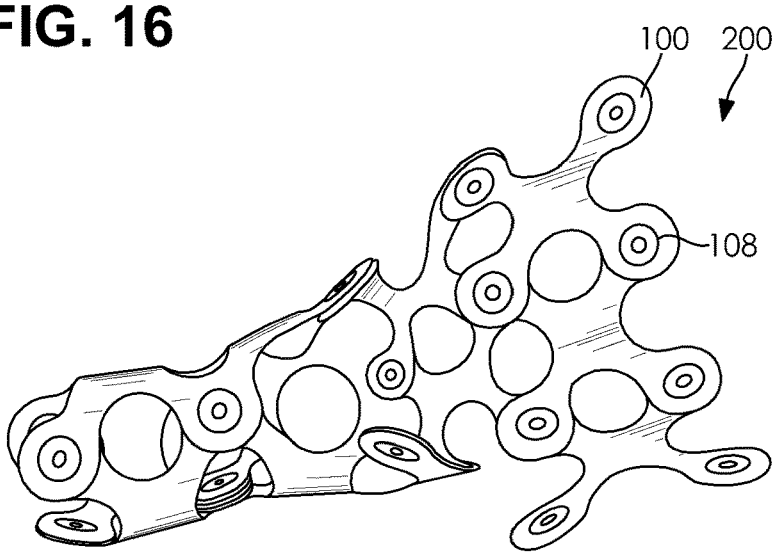
Figure 18:
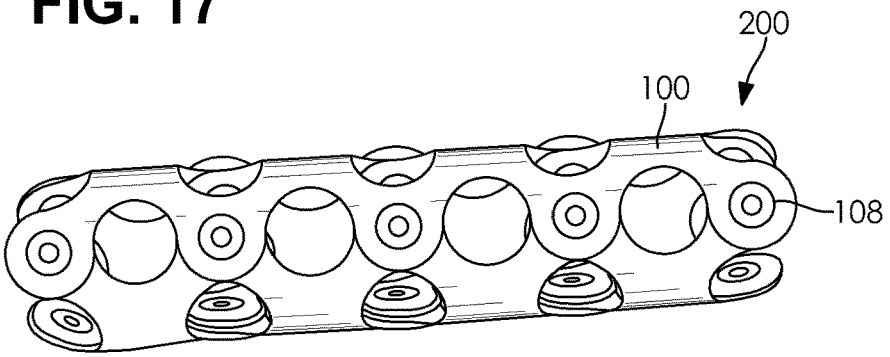
Figure 19:
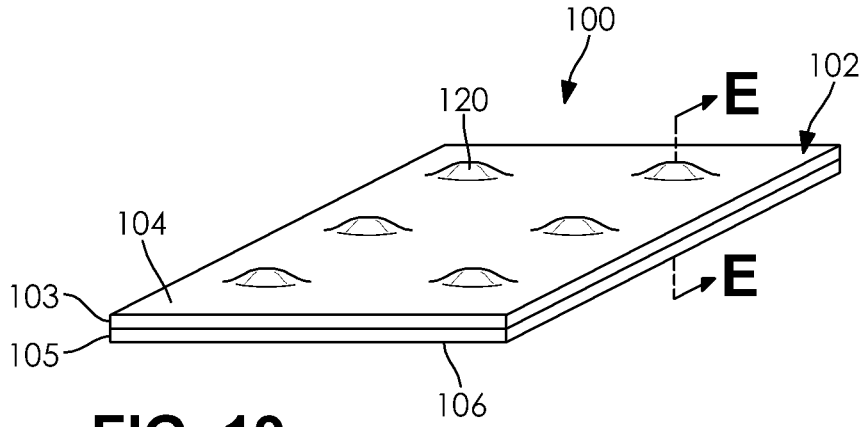
Figure 20:
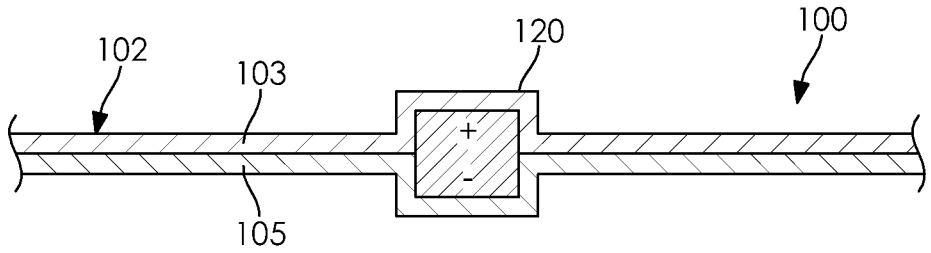
Figure 21:
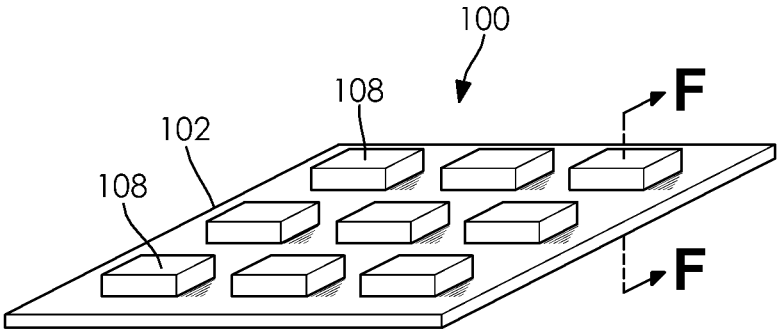
Figure 22:
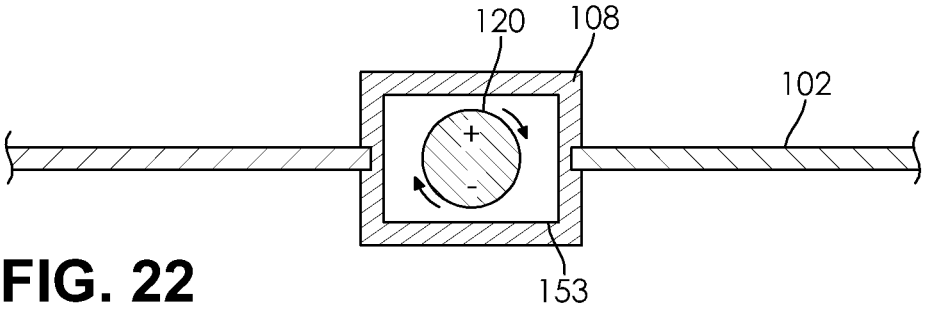
Figure 23:
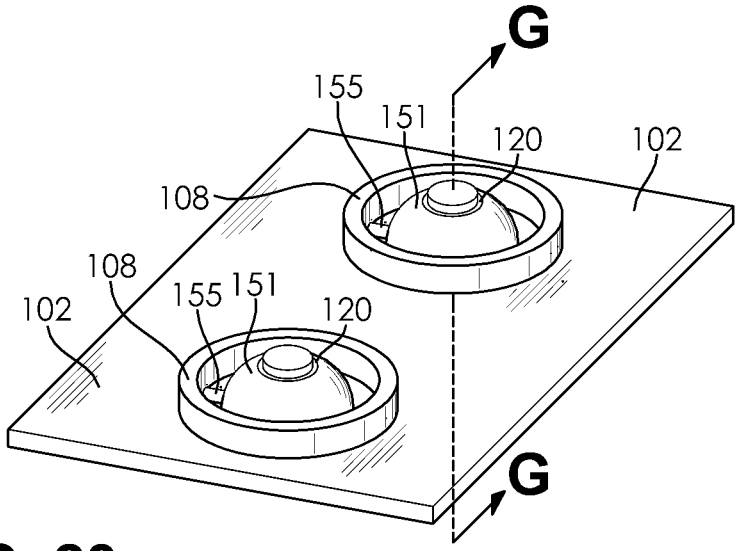
Figure 24:
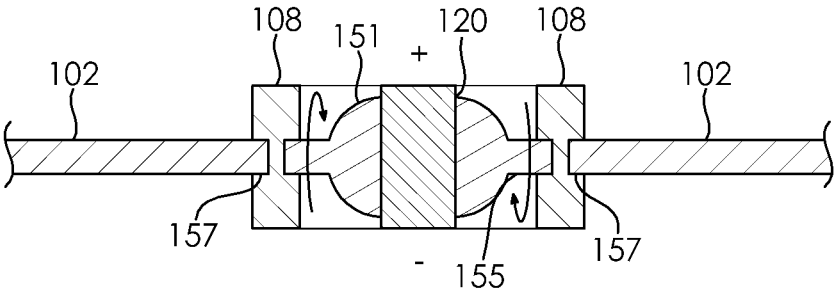

FIG. 17 further illustrates the plurality of construction units shown in FIG. 16, depicted in operation and being connected to one another arranged to form a structure in a second step;

FIG. 18 illustrates the completed structure formed by the plurality of construction units shown in FIG. 17;

FIG. 19 is a top perspective view of a construction unit according to a further embodiment of the present disclosure;

FIG. 20 is a cross-sectional side elevational view of the construction unit taken at section line E-E in FIG. 19, and depicting an embedded magnet according to one embodiment of the present disclosure;

FIG. 21 is a top perspective view of a construction unit according to a further embodiment of the present disclosure;

FIG. 22 is a cross-sectional side elevational view of the construction unit taken at section line F-F in FIG. 21, and depicting a freely rotating magnet within a fixed housing according to one embodiment of the present disclosure;

FIG. 23 is a top perspective view of a construction unit according to a further embodiment of the present disclosure; and FIG. 24 is a cross-sectional side elevational view of the construction unit taken at section line G-G in FIG. 23, and depicting a magnet fixed to a rotating housing according to one embodiment of the present disclosure.

DETAILED DESCRIPTION OF THE INVENTION

The following description is merely exemplary in nature and is not intended to limit the present disclosure, application, or uses. It should also be understood that throughout the drawings, corresponding reference numerals indicate like or corresponding parts and features. In respect of the methods disclosed, the order of the steps presented is exemplary in nature, and thus, is not necessary or critical unless otherwise disclosed.

As shown in FIGS. 1-21, a construction unit 100 may have a main body 102. The main body 102 may be formed from a flexible material. The main body 102 may have a first 104 side and a second side 106. The construction unit 100 may have a plurality of magnetic connectors 108 attached to the main body 102.

As used herein, the term "main body" is defined to include any body with a width and a length that are substantially greater than its thickness. The main body 102 may include one or more layers or sheets of the flexible material, as also described further herein. It should be appreciated that the main body 102 will permit the magnetic connectors 108 to be embedded therein or attached thereto, or facilitate a placement of the magnetic connectors 108 between two or more layers or sheets of the main body 102, as also described further herein. The term "main body" shall not be construed to imply any specific shape or overall dimensions unless otherwise disclosed and is intended to include any and all possible shapes and dimensions.

The flexible material of the present disclosure is pliable but resilient, such that the flexible material will return to an original shape after being deformed or bent without significant creasing or tearing. It should be understood that in certain embodiments the flexible material may also retain its shape after being bent or deformed. The flexible material is also water resistant and does not degrade significantly with exposure to water. The flexible material may also be resistant to degradation with exposure to oils. In certain embodiments, the flexible material that forms the main body 102 may be selected from a group consisting of paper, synthetic paper, leather, synthetic leather, elastomer, plastic, rubber, metal, fabric, composites, and combinations thereof.

In particular embodiments, the flexible material may be a waterproof synthetic paper. For example, the flexible material may be a polyester- or polyolefin-based synthetic paper. The polyester- or polyolefin-based synthetic paper may have a thickness between about 3.7 mil and about 13.7 mil, and a weight between about 125 gsm and about 510 gsm, as non-limiting examples. The polyester- or polyolefin-based synthetic paper may also have a melting point between about 285° F. and about 450° F., in another example. Advantageously, fabrication of the main body 102 from polyester- or polyolefin-based synthetic paper provides lightweight and waterproof construction units 100 that may be repeatedly used without undesirably tearing or creasing. Although the polyester- or polyolefin-based synthetic paper has been found to be especially suitable for the main body 102, it should be understood that any other suitable material may be selected by a skilled artisan, as desired.

The main body 102 of the present disclosure may also have dimensions that facilitate a manual deformation or bending of the main body 102 in operation. In certain embodiments, the flexible material of the main body 102 may have a thickness between about 0.1 millimeter and about 25 millimeters. In a more particular embodiment, the flexible material of the main body 102 may have a thickness between about 0.1 millimeters and about 5 millimeters. In a most particular embodiment, the flexible material of the main body 102 may have a thickness between about 0.1 millimeters and about 1.0 millimeters. In a specific embodiment, the thickness of the main body 102 may be about 0.3 millimeters. One of ordinary skill in the art may also select other suitable thicknesses for the main body 102 within the scope of the disclosure.

As shown in FIGS. 1-5, the main body 102 may have a central hub 110. The central hub 110 may have a plurality of arms 112 disposed thereon. Each of the plurality of arms 112 may radiate outwardly from the central hub 110 and have a free end 114. In certain embodiments, as illustrated in FIGS. 1-5 and 15-18, the main body 102 may be substantially X-shaped with four of the arms 112 disposed on the central hub 110. Although the main body 102 having the X-shape is shown and described herein as one particular example, it should be understood that this disclosure contemplates any other suitable shape for the main body 102.

The magnetic connectors 108 may be disposed on the main body 102. For example, the magnetic connectors 108 may be disposed on the arms 112 of the main body. The magnetic connectors 108 may be disposed adjacent the free ends 114 of the arms 112, for example. In certain cases, the magnetic connector 108 may be disposed at the central hub 110. In a further example, the magnetic connectors 108 may be spaced apart from one another across an area of the main body 102. In particular, it has been found that the magnetic connectors 108 should be disposed on the main body 102 at least about 60 mm to 70 mm apart, in order to best facilitate use of the construction units 100. Other suitable locations and arrangements for the magnetic connectors 108 may also be employed.

As depicted in FIGS. 6-12, each of the magnetic connectors 108 may have a first portion 116, a second portion 118, and a magnet 120. The first portion 116 may be disposed adjacent to the first side 104 of the main body 102. The second portion 118 may be disposed adjacent to the second side 106 of the main body 102. The magnet 120 may be disposed between the first portion 116 and the second portion 118. The first portion 116 and the second portion 118 may thereby secure the magnet 120 to the main body 102.

As shown in FIGS. 1-4, 6-7, and 10-12, the magnetic connectors 108 of the present disclosure may have a generally hexagonal shape. It should be appreciated that the hexagonal shape may militate against undesirable rotation of various parts that may be connected to the magnetic connectors 108, in operation. The hexagonal shape may also be provided with rounded corners, which may militate against an unintended catching or cutting of the main body 102 where the main body 102 has been deformed or bent as described further herein. However, the magnetic connectors 108 may be any other suitable shape, including circles and squares, as non-limiting examples.

The magnetic connectors 108 may be fabricated from a lightweight plastic material such as acrylonitrile butadiene styrene (ABS), by a molding process such as injection molding, as nonlimiting examples. It should be understood, the magnetic connectors 108 can be formed from any other suitable material, including other thermoplastic materials such as polyethylene, for example. Any suitable processes for forming the magnetic connectors 108 may also be employed, as desired.

As shown in FIGS. 6-12, the first portion 116 of the magnetic connector 108 may have an exterior surface 122 and an interior surface 124. The first portion 116 may have a central aperture 126 formed therethrough. The central aperture 126 may extend from the exterior surface 122 to the interior surface 124. The central aperture 126 may be configured to receive the magnet 120. In certain embodiments, the central aperture 126 may be formed in the interior surface 124, but not extend all the way to the exterior surface 122 of the first portion 116. In other words, the central aperture 126 may be provided in the form of a closed recess, which is open only to the interior surface 124 and not to the exterior surface 122.

Figure 7:
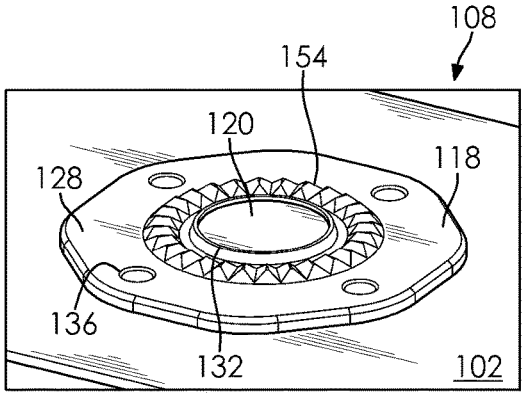
FIG. 7 is a bottom perspective view of the magnetic connector taken at callout B in FIG. 2.
Figure 11:
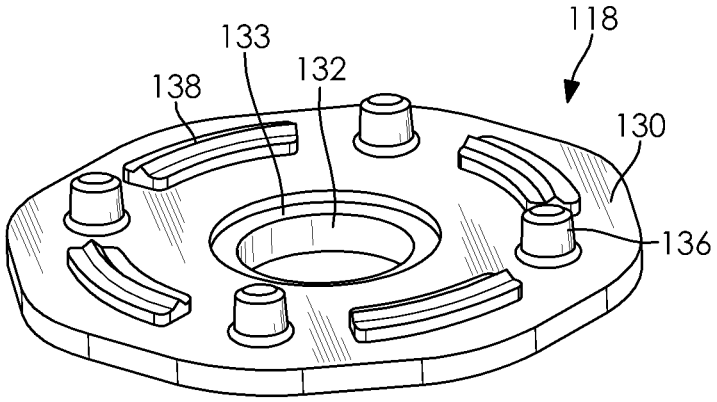
FIG. 11 is a top perspective view of a second portion of the magnetic connector shown in FIG. 6.
Figure 12:
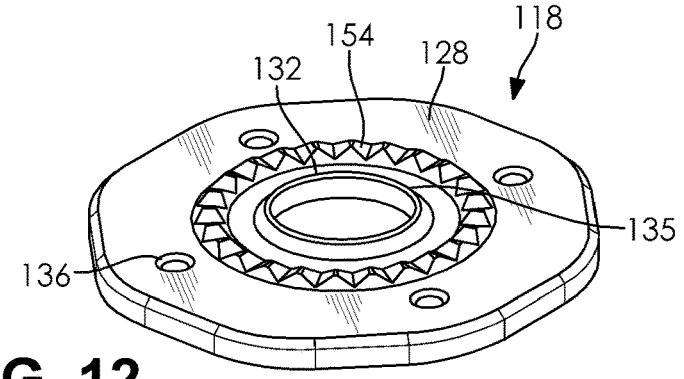
FIG. 12 is a bottom perspective view of the second portion of the magnetic connector shown in FIG. 11.

As shown in FIGS. 7 and 11-12, the second portion 118 of the magnetic connector 108 may have an exterior surface 128 and an interior surface 130. The second portion 118 may have a central aperture 132 formed therethrough from the exterior surface 128 to the interior surface 130. The central aperture 132 may also be configured to receive the magnet 120. In certain embodiments, the central aperture 132 may be formed in the interior surface 130 without passing through the second portion 118 to the exterior surface 128. As with the first portion 116 of the magnetic connector 108, the central aperture 132 may be provided in the form of a closed recess, which is open only to the interior surface 130 and not to the exterior surface 128.

As further shown in FIGS. 11 and 12, the second portion 118 may have a ledge 133 formed in the interior surface 130 thereof. The ledge may circumscribe the central aperture 132. The second portion 118 may have an annular ring 135. The annular ring 135 may be formed on the exterior surface 128 thereof. The annular ring may circumscribe the central aperture 132.

Figure 10:
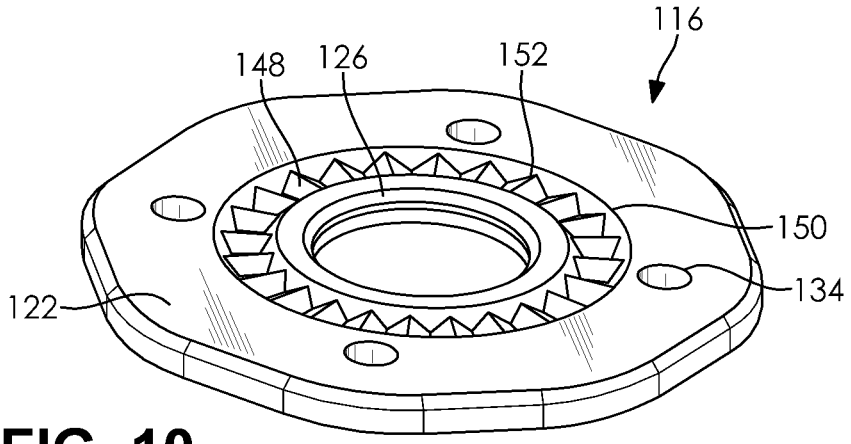
FIG. 10 is a top perspective view of a first portion of the magnetic connector shown in FIG. 6.

Referring now to FIG. 10, the first portion 116 of each of the magnetic connectors 108 has at least one female component 134. The female component 134 may be a hole disposed through the first portion 116 from exterior surface 122 to the interior surface 124. It should also be appreciated that the female component 134 may only be open on the interior surface 124 and may be closed (not shown) on the exterior surface 122. More particularly, the first portion 116 may have a plurality of the female components 134 arranged around the central aperture 126 of the first portion 116.

In a most particular example, also illustrated in FIG. 10, the female component 134 may include four holes that are formed through the first portion 116 from the exterior surface 122 to the interior surface 124. The four holes may be substantially evenly spaced around the central aperture 126 of the first portion 116.

With reference to FIG. 11, the second portion 118 of each of the magnetic connectors 108 may have at least one male component 136. The male component 136 of the second portion 118 may correspond in size and shape to the female component 134 of the first portion 116. The male component 136 may protrude outwardly from the interior surface 130 of the second portion 118. The male component 136 may formed separately and then subsequently attached to the interior surface 130, or the male component 136 may be coformed with the remainder of the second portion 118 on the interior surface 130, as desired.

In a most particular example, also shown in FIG. 11, the male component 136 may include four pegs. The pegs are formed on the interior surface 130 of the second portion 118. The male components 136 may also be substantially evenly spaced around the interior surface 130.

It should be understood that the male component 136 may be adapted to be received by the female component 134 upon assembly of the magnetic connector 108. For example, the male component 136 may be friction- or press-fit into the female component 134 such that the first portion 116 and the second portion 118 are retained together. In other examples, the male component 136 and the female component 134 may not be press fit, but may instead serve to align the first portion 116 and the second portion 118 for additional connecting procedures, as described further herein.

Advantageously, the male and female components 134, 136 provide a secure coupling for the first and second portion 116, 118, and may militate against the first and second portion 116, 118 undesirably separating during use. It should be understood that one having skill in the art may select any suitable sizes and shapes for the female and male components 134, 136, and any suitable placement or configurations of the female and male components 134, 136 on the first and second portion 116, 118, as desired.

Figure 9:
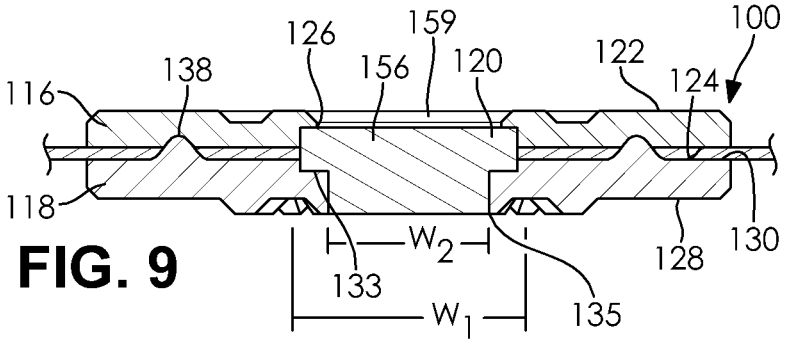
FIG. 9 is a cross-sectional side elevational view of the magnetic connector taken at section line D-D in FIG. 6.

With continued reference to FIG. 11, the second portion 118 of the magnetic connector 108 may have at least one welding bridge 138. The welding bridge 138 may be provided in addition to the male components 136 described hereinabove, and can either be formed separately and then added to the interior surface 130 or conformed with the remainder of the second portion 118. The welding bridge 138 may be defined by an elongate rib having an uppermost peak portion that is configured to be welded to the interior surface 124 of the first portion 116, for example, as shown in FIG. 9. In particular, as shown in FIG. 11, the at least one welding bridge 138 may include four of the welding bridges 138 spaced apart from one another and arranged around the central aperture 132 of the second portion 118. One having skill in the art may also select any other suitable size, shape, number, and arrangement for the at least one welding bridge 138, as desired.

As shown in FIG. 9, the at least one welding bridge 138 may connect the interior surface 130 of the second portion 118 with the interior surface 124 of the first portion 116. It should be understood that the at least one welding bridge 138 is disposed through the main body 102 to firmly secure the magnetic connector 108 to the main body 102. In a particular example, the at least one welding bridge 138 may be ultrasonically welded to the interior surface 124 of the first portion 116, in order to couple the first portion 116 and the second portion 118. It should be understood that one having skill in the art may also select any suitable means for coupling the first portion 116 and the second portion 118 within the scope of the disclosure.

Figure 13:
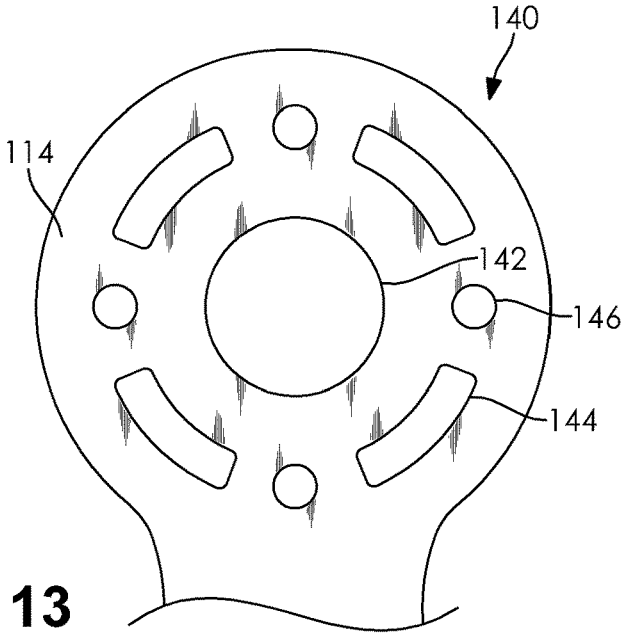
FIG. 13 is a top plan view of a plurality of apertures preformed in the magnetic connector shown in FIG. 1.

Referring now to FIG. 13, the main body 102 may have a plurality of preformed apertures 140 formed therethrough. At least one of the preformed apertures 140 may receive one of the magnetic connectors 108. In certain embodiments, the preformed apertures 140 may be formed in the central hub 110, the plurality of arms 112, the free ends 114 of the arms 112, or any combination thereof. One skilled in the art may select any suitable location for the plurality of preformed apertures 140, as desired.

The sizes and shapes of the preformed apertures 140 may be selected based upon the structure of the magnetic connectors 108 with which they are intended to be used. In particular, the plurality of preformed apertures 140 may include a magnet aperture 142, a welding bridge aperture 144, and a male component aperture 146. The magnet aperture 142 may receive the magnet 120. The welding bridge aperture 144 may receive the welding bridge 138 of the second portion 118. The male component aperture 146 may receive the male component 136. Other suitable types, including different sizes and shapes of, the preformed apertures 140 may also be employed.

In a most particular embodiment, the welding bridge apertures 144 and the male component apertures 146 may be spaced apart from one another and generally circumscribe the magnet aperture 142. The welding bridge apertures 144 and the male component apertures 146 may be arranged in an alternating fashion, and substantially evenly disposed around the magnet aperture 142. Other suitable arrangements may also be used.

The means for creating the preformed apertures 140 may include a die cutting process, as one-non-limiting example. It should be appreciated that the creation of the preformed apertures 140 in the flexible material by die cutting may allow the second portion 118 to pass through the main body 102 without requiring an uncontrolled tearing or puncturing of the main body 102 by the male components 136 and the welding bridges 138 of the second portion 118 upon assembly. It should likewise be understood that the use of the preformed apertures 140 therefore contributes to superior longevity of the construction unit 100 over time, with repeated deformation and bending, due to the absence the uncontrolled tears or punctures that would otherwise be present in the main body 102. Other suitable means for creating the preformed apertures 140 without excessive tearing of the flexible material may also be employed, as desired.

Figure 1:
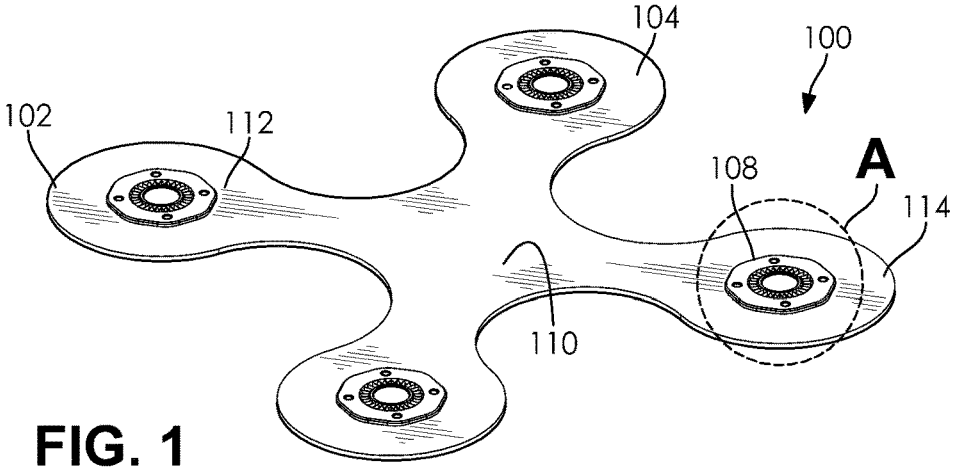
FIG. 1 is a top perspective view of a construction device according to one embodiment of the present disclosure.
Figure 2:
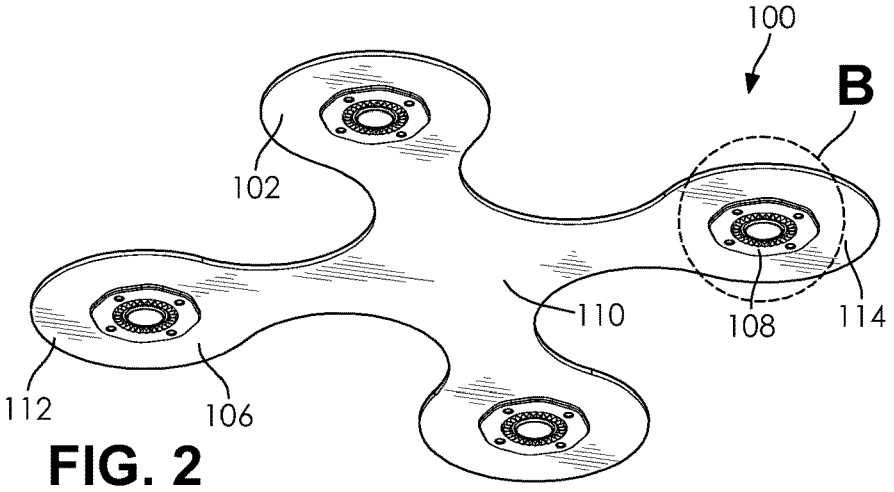
FIG. 2 is a bottom perspective view of the construction unit shown in FIG. 1.
Figure 3:
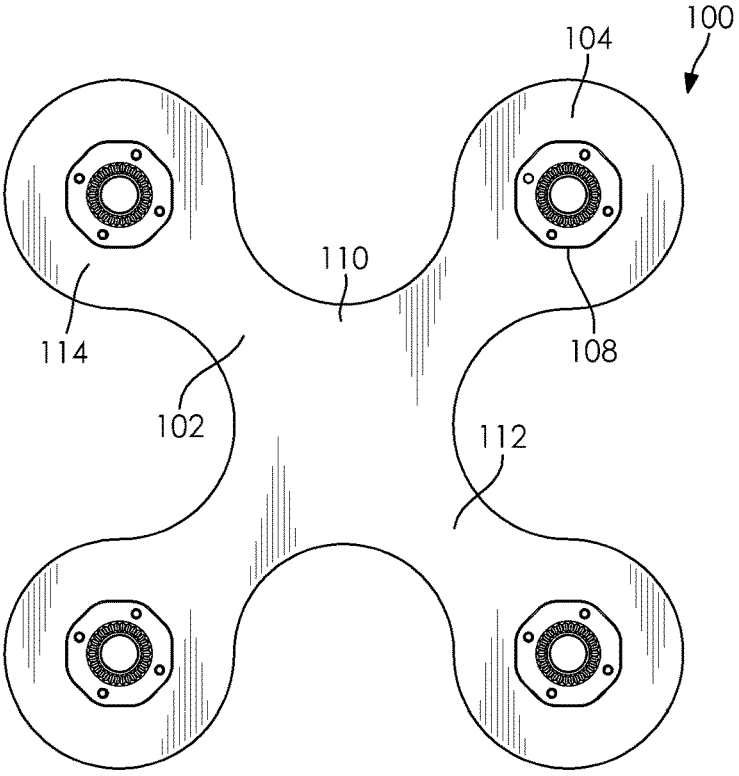
FIG. 3 is a top plan view of the construction unit shown in FIG. 1.
Figure 4:
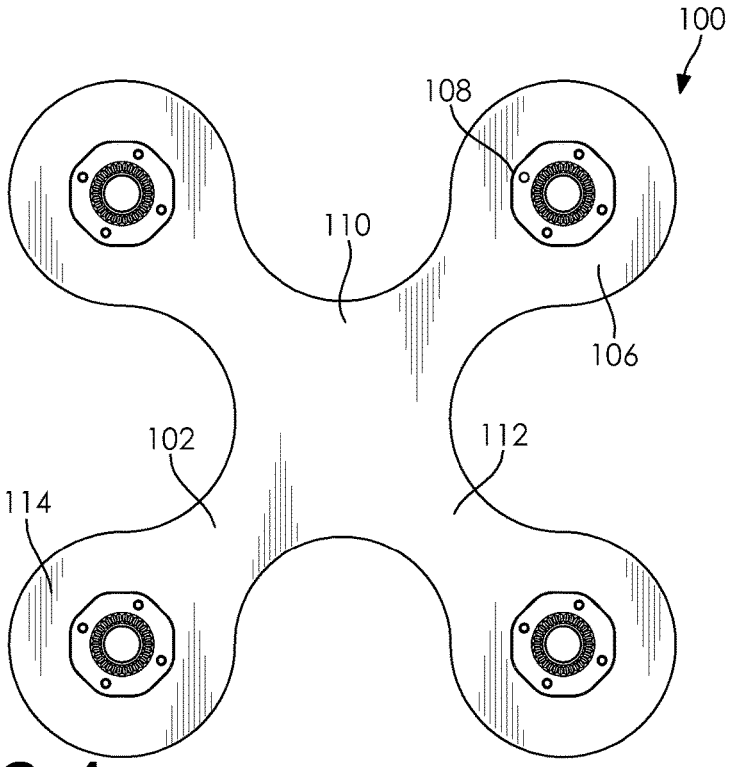
FIG. 4 is a bottom plan view of the construction unit shown in FIG. 1.
Figure 5:
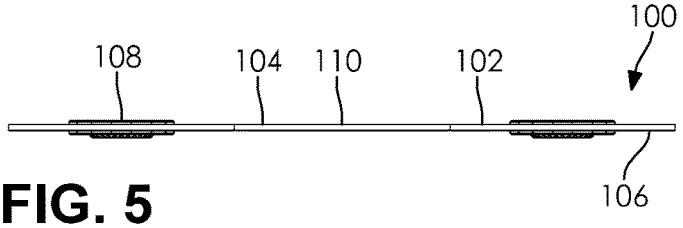
FIG. 5 is a side elevational view of the construction unit shown in FIG. 1.
Figure 6:
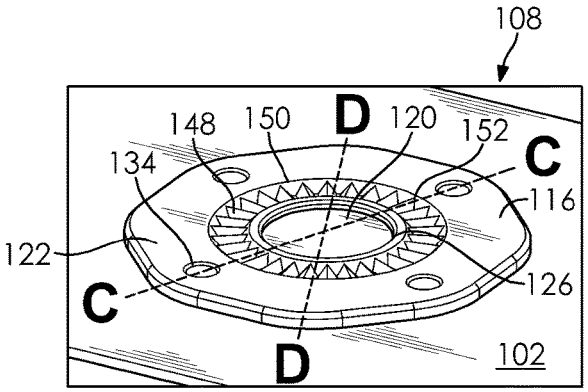
FIG. 6 is a top perspective view of a magnetic connector of the construction unit taken at callout A in FIG. 1.

With renewed reference to FIGS. 6 and 10, the first portion 116 has a plurality of first ratchet teeth 148. The first ratchet teeth 148 may be disposed on the exterior surface 122 around the central aperture 126 of the first portion 116. In certain embodiments, the first portion 116 may have an annular groove 150 formed in the exterior surface 122 around the central aperture 126 of the first portion 116. The first ratchet teeth 148 may be disposed on the exterior surface 122 within the annular groove 150.

In certain examples, the first ratchet teeth 148 each have a peak 152. The peaks 152 of the first ratchet teeth 148 may be spaced apart from a plane on which the remainder of the exterior surface 122 is disposed. For example, the peaks 152 may be recessed in the annular groove 150 such that each of the peak 152 is disposed below the entirety of the exterior surface 122.

As shown in FIGS. 7 and 12, the second portion 118 also has a plurality of second ratchet teeth 154. The second ratchet teeth 154 may be disposed on the exterior surface 128 and arranged as an annular ring around the aperture 132 of the second portion 118. The second ratchet teeth 154 may protrude outwardly from the exterior surface of the second portion.

In operation, the first ratchet teeth 148 of a first one of the magnetic connectors 108 may be configured to cooperate with the second ratchet teeth 154 of a second one of the magnetic connectors 108. Advantageously, the cooperation of the first ratchet teeth 148 and the second ratchet teeth 154 militate against undesirable rotation of the construction units 100 where connected magnetically. Further, the cooperation of the first and second ratchet teeth 148, 154 provides a desirable tactile feel upon turning the magnetic connectors 108 relative to each other while connected magnetically.

It should also be appreciated that the aforementioned recessing of the peaks 152 of the first ratchet teeth 148 in the annular groove 150 of the first portion 116, together with the outward protrusion of the second ratchet teeth 154 of the second portion 118, may also provide for a more secure or stable connection of the first and second ones of the magnetic connectors 108 in operation.

As disclosed hereinabove, each of the magnetic connectors 108 contains the magnet 120, which is adapted to cause the magnetic connection to adjacent magnetic connectors 108. The magnet 120 has a sufficient magnetic strength or field to permit for the selective magnetic connection where the magnetic connectors 108 are manually disposed adjacent one another, while also permitting for a selective manual disconnection of the magnetic connectors 108 by a user such as a child. In particular, the magnet 120 may be a rare-earth type magnet or magnet alloy. As nonlimiting example, the magnet 120 may include a neodymium iron boron (NdFeB), samarium cobalt (SmCo), alnico, ceramic, ferrite or a combination thereof. Any other suitable type of magnet 120 chosen by one having skill in the art.

In certain examples, as shown in FIGS. 1-5 and 20, the magnet 120 is immovably fixed to the main body 102. The immovable fixation of the magnet 120 may be provided by a friction- or press-fit, for example. Adhesives may also be employed to affix the magnet 120 in the magnetic connector 108. However, in other examples shown in FIGS. 21-22, the magnet 120 may also freely rotate inside the magnetic connector 108. It should be appreciated that the freely rotating magnet 120 may allow the user to connect adjacent magnetic connectors 108 regardless of the location of the magnet poles, which will freely rotate to the correct orientation. The freely rotating magnet 120 may be loosely disposed inside of a plastic or metal housing 153, for example, which is encapsulated within the magnetic connector 108 or the main body 102. Other suitable means for affixing the magnet 120 to the magnetic connector 108 or to the main body 102 direction, in either an immovable or movable form, may also be employed.

Figure 8:
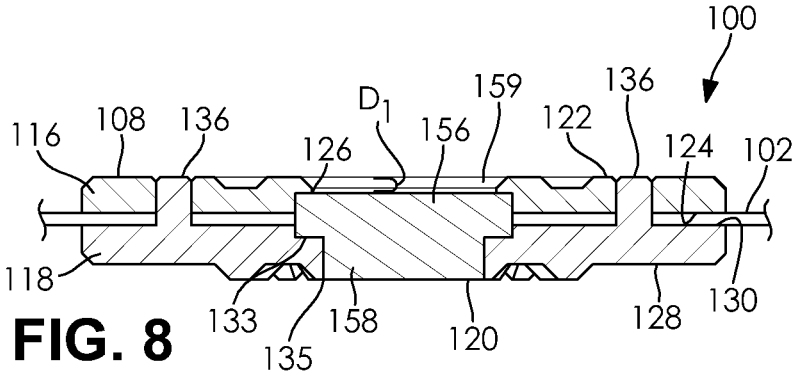
FIG. 8 is a cross-sectional side elevational view of the magnetic connector taken at section line C-C in FIG. 6.

As depicted in FIGS. 8-9, the magnet 120 has a first section 156 and a second section 158. The first section 156 may have a first width (W1). The second section 158 may have a second width (W2). The first width (W1) is greater than the second width (W2). The first section 156 of the magnet 120 may rest on or abut the ledge 133 of the second portion 118 of the magnetic connector 108. The second section 158 of the magnet 120 may be received by the central aperture 132 of the second portion 158 of the magnetic connector 108.

In certain embodiments, as also shown in FIGS. 8-9, the magnet 120 may be spaced apart from the exterior surface 122 of the first portion 116 a distance (D1) and together with a surrounding area of the first portion 116 defines a recess 159. In operation, the annular ring 135 of a first one of the magnetic connectors 108 may be configured to rest on the exterior surface 122 and be received by the recess 159 of a second one of the magnetic connectors 108. The recess 159 may be contoured to friction- or press-fit with the annular ring 135 in certain examples. Advantageously, the cooperation of the annular ring 135 and the recess 159 of the exterior surface 122 may provide for a more secure or stable connection of the first and second ones of the magnetic connectors 108 in operation.

According to an alternative embodiment, shown in FIGS. 19-20, the main body 102 may include a plurality of sheets 103, 105. The plurality of sheets 103, 105 may include a first sheet 103 and a second sheet 105. The magnetic connectors 108 may be disposed between the first sheet 103 of flexible material and the second sheet 105 of magnetic material. One of the magnetic connectors 108 may connect to another of the magnetic connectors 108 disposed within the same main body 102. The magnetic connectors 108 of one main body 102 may also connect to the magnetic connectors 108 disposed on a separate and different main body 102. It should be understood that the construction units 100 may thereby be connected to themselves, or to other construction units. The other construction units may be of any size or shape. One having skill in the art may also select the size, shape, number, and arrangement for the magnetic connectors 108 between the first and second sheets 103, 105, as desired.

In another alternative embodiment, shown in FIGS. 23-24, the magnet 120 may be disposed in a rotating magnet housing 151. The magnet 120 may extend outwardly past the rotating magnet housing 151, so as to be connected with other magnets where presented adjacent the magnet housing 151. For example, in operation, the magnet 120 of a first construction unit 100 may directly connect to the magnet 120 of the magnet 120 of another construction unit 100.

The rotating magnet housing 151 may have a pair of axles 155. Each one of the pair of axles 155 may be disposed on an end of the rotating magnet housing 151. Each one of the pair of axles 155 may be rotatably coupled to the magnetic connector 108, for example, by the axles 155 being rotatably disposed within corresponding holes formed in the magnetic connector 108, such that the magnet housing 151 may freely spin. In this embodiment, the magnetic connector 108 may have a main body aperture 157. The main body aperture 157 may receive the main body 102. The fixation of the main body 102 to the magnetic connector 108 may be provided by a friction-fit, for example, or the fixation may be provided by any other suitable means including those means described hereinabove with respect to other types of the magnetic connector 108. Adhesives may also be employed to affix the main body 102 in the magnetic connector 108. Though this particular magnet 120 configuration is depicted on the flexible main body 102 of the construction unit 100, it should be understood that the magnet 120 configuration could be used on any construction unit 100 or on the flexible link 180, as desired.

Figure 14:
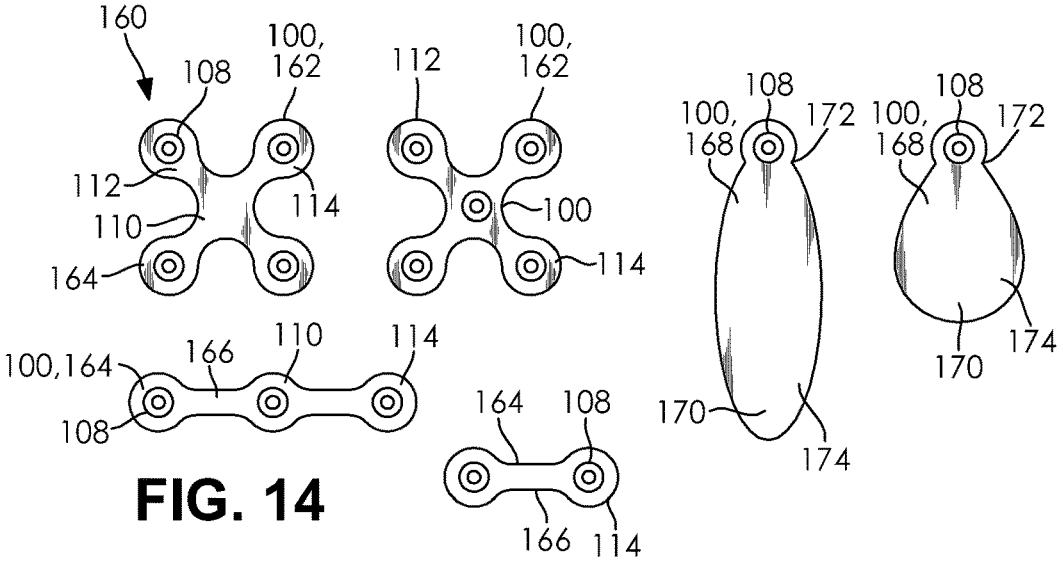
FIG. 14 illustrates a plurality of construction units of a kit according to one embodiment of the present disclosure.

As shown in FIG. 14, a kit 160 for construction of a structure 200 may include the plurality of separate construction units 100. Each of the construction units 100 may have the main body 102 formed from the flexible material. As described hereinabove, the main body 102 may have the first side 102 and the second side 104. Each of the construction units 100 may have the at least one magnetic connector 108 attached to the main body 102.

For example, the plurality of separate construction units 100 includes a first unit 162. The first unit 162 may have the four arms 112 extending outwardly from the hub 110. Each of the arms 112 may have a free end 114. The plurality of magnetic connectors 108 may include at least four first unit magnetic connectors 108. Each of the first unit magnetic connectors 108 may be disposed adjacent the free end 114 of one of the arms 112. In certain embodiments, the first unit 162 may include a fifth magnetic connector 108. The fifth magnetic connector 108 may be disposed in the hub 110.

The plurality of separate construction units 108 may include a second unit 164. The second unit 164 may have an elongate body 166 with free ends 114. The plurality of magnetic connectors 108 may include at least two second unit magnetic connectors 108. Each of the second unit magnetic connectors 108 may be disposed adjacent one of the free ends 114 of the elongate body 166. In certain embodiments, the second unit 164 may include three magnetic connectors 108.

The plurality of separate construction units includes a third unit 168. The third unit 168 may have a generally ovoid body 170. The ovoid body 170 may have a first end 172 and a second end 174. The plurality of magnetic connectors 108 may include a third unit magnetic connector 108. The third unit magnetic connector 108 may be disposed adjacent the first end 172 of the generally ovoid body 170.

It should be understood that the kit 160 contemplated by this disclosure may include any suitable shape other than those shapes depicted in FIG. 14. The kit 160 may include, as non-limiting examples, squares, rectangles, and circles.

Figure 15A:
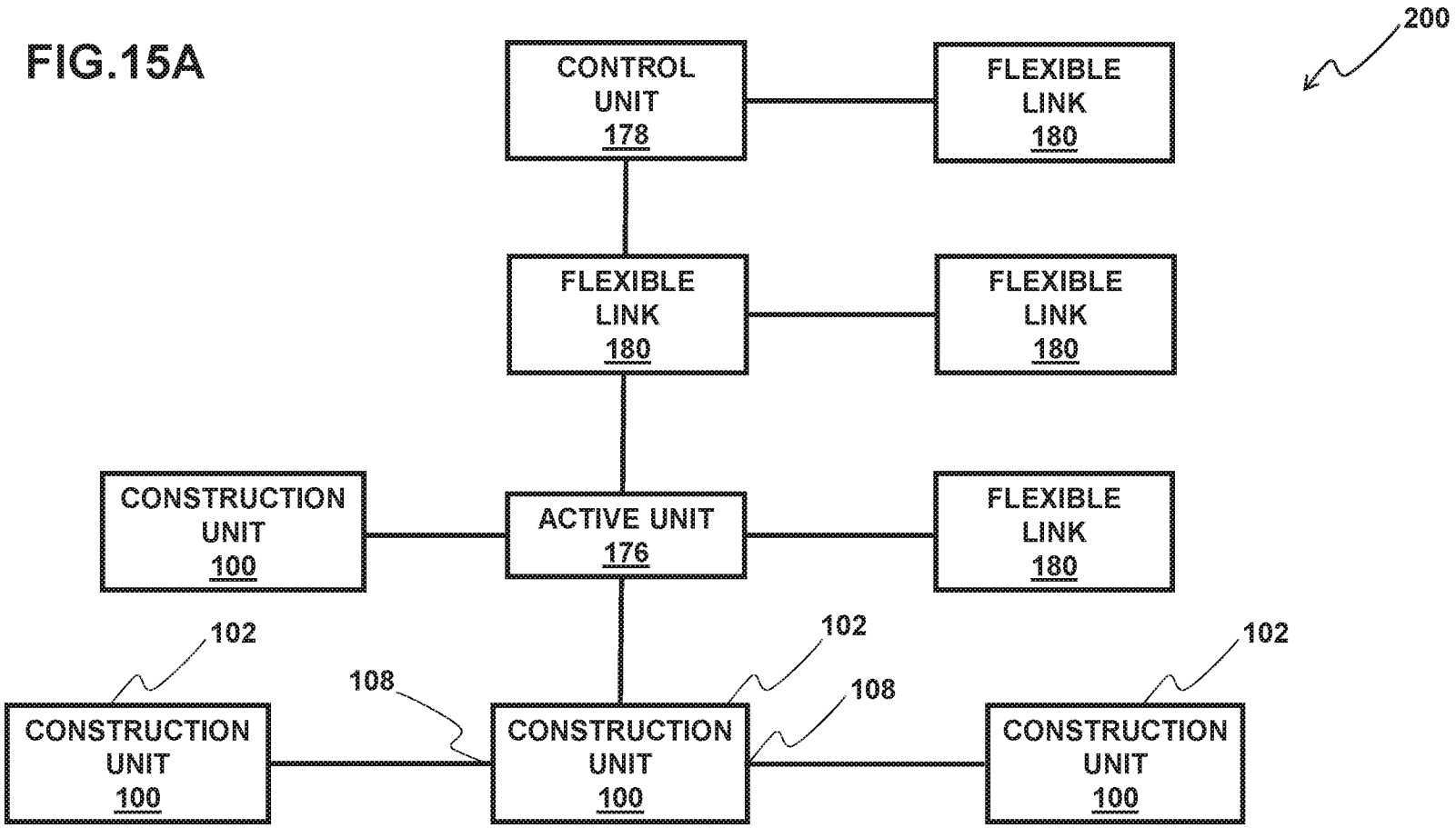
FIG. 15A is a schematic illustration of an active unit, a control unit, and a flexible link of the kit shown in FIG. 14, and depicted in a first structural configuration.
Figure 15B:
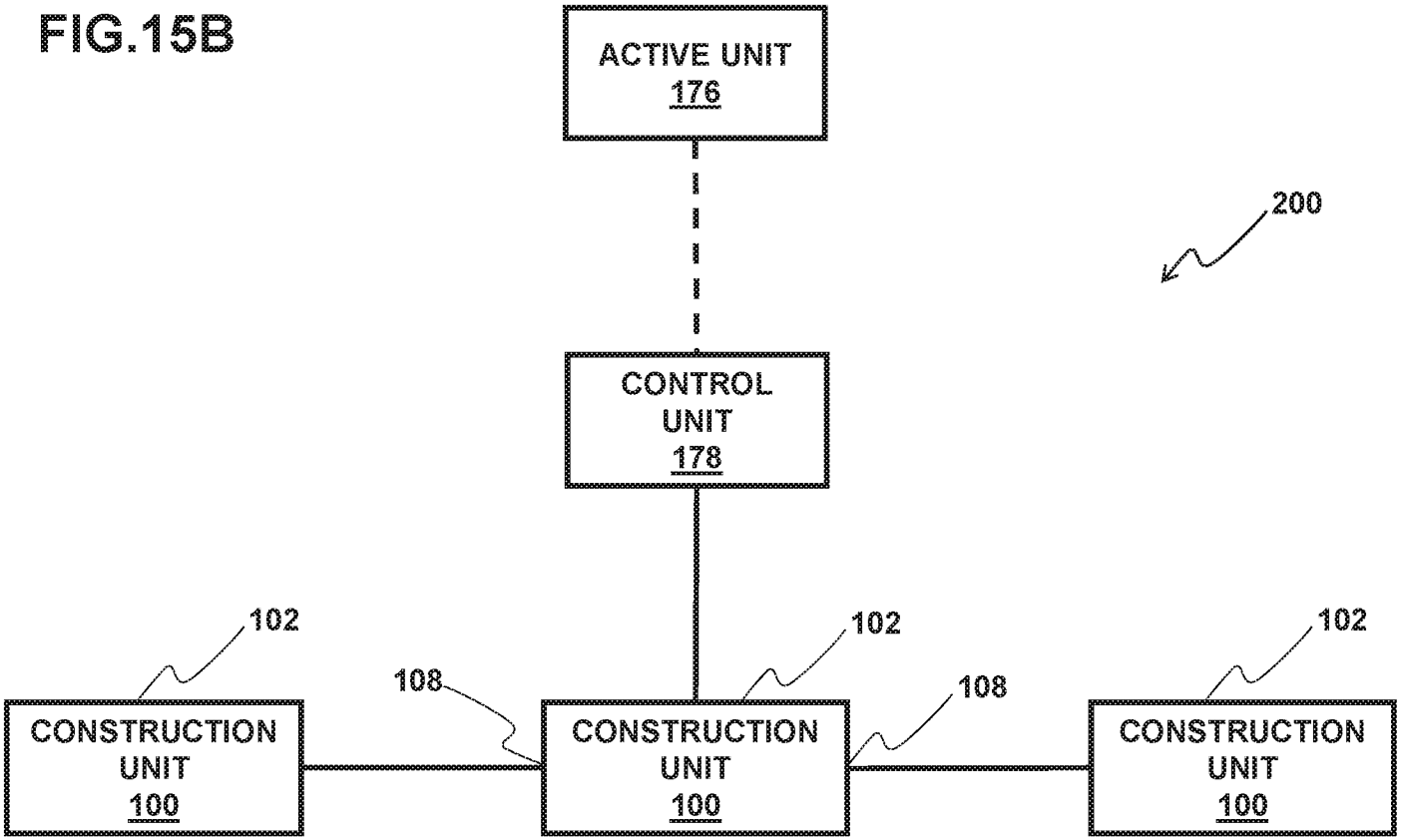
FIG. 15B is a schematic illustration of an active unit and a control unit of the kit shown in FIG. 14, and depicted in a second structural configuration.

Referring now to FIGS. 15A and 15B, the kit 160 may further include at least one active unit 176 and at least one control unit 178. The active unit 176 may be configured to be in electronic communication with the control unit 176. The active unit 174 and the control unit 176 may be each further configured to be disposed on one of the magnetic connectors 108 of one of the construction units 100. It should be understood that the active unit 176 and the control unit 178 may be a single component or may be two separate components of the kit 160.

The active unit 176 may include input sensors such as proximity or light sensors, orientation sensors, sound sensors or output components with functional capabilities such as at least one of sound, light, and movement. Advantageously, once the active unit 176 is activated, the plurality of construction units 108 will "come to life" with an added technological feature such as movement or a light.

The control unit 178 may be in electrical communication with a battery (not shown). The battery may be included in the control unit 178 assembly or may be provided as an independent unit. The control unit 178 may also have a microprocessor and a memory. In a non-limiting example, the control unit 178 may be formed on a printed circuit board (PCB). The PCB may include conductive tracks, pads and other features etched from one or more sheet layers of copper laminated onto and/or between sheet layers of a non-conductive substrate. The PCB may be single-sided (one copper layer), double-sided (two copper layers on both sides of one substrate layer), or multi-layer (outer and inner layers of copper, alternating with layers of substrate). Other suitable constructions for the PCB may also be employed within the scope of the disclosure.

The memory may be provided in the form of a tangible, non-transitory, processor readable medium that is in communication with the microprocessor. The microprocessor may be adapted to execute instructions in the form of software tangibly encoded on the memory. The control unit 176 may be configured to one of selectively and automatically activate the active device 176 in operation. The control unit 178 may also be configured to execute certain programmable actions, as well as permit the user to enter the programmable instructions and store the same on the memory of the control unit 178. In particular, the control unit 178 may include a human interface such as buttons, dials, touch-screens or the like, which permit the user to interact with the control unit 178, as desired.

The kit 160 may further include at least one flexible link 180. The flexible link 180 may include an insulated wire that configured to place the control unit 176 in electrical communication with the active unit 176. In one example, the flexible link 180 may be a flat PCB connector cable that is configured to connect to the PCB. However, the flexible link 180 may also be fabricated with other suitable materials and constructions within the scope of the disclosure. It should be understood that the flexible links 180 may transfer electricity and signals or data.

In addition to the flexible link 180 being configured to place the active unit 176 in electrical communication with the control unit 178, the flexible link 180 may further be configured to be disposed on the magnetic connector 108 of the construction unit 100. For example, an end portion of the flexible link 180 may have at least one magnetic connector 108 or may be formed from a material that may be magnetically attracted to the magnetic connector 108 of the construction unit. The flexible link 180 may thereby be directly connected to the active unit 176 or may be disposed between the active unit 176 and the construction unit 100 where the active unit is otherwise connected to the construction unit 100 by the magnetic connector 108. Other suitable means for placing the active unit 176 in communication with the control unit 178 are contemplated and may also be employed.

It should be understood that the flexible links 180 may be connected in various configurations to other flexible links 180, the control units 178, and the construction units 100, for example, as shown in FIG. 15A. The flexible links 180 may be provided with a split for example. The split may allow the flexible link to connect to a plurality of construction units 100. Further, more than one flexible link 180 or more than one active unit 176 may be in electrical communication with one control unit 178. Where these units are connected, it should be understood that any rotation about the magnetic connectors of any unit may not inhibit the transfer of electricity or signals or data. For example, the electricity may pass from the flexible link 180 to multiple magnetic connectors 108 that may be attached to the flexible link. Other suitable configurations may also be used, as desired.

The present disclosure further includes a method for construction of the structure 200, for example, as shown in FIGS. 16-18. The structure 200 may be flat or two-dimensional, or may be three-dimensional, depending on the intent of the user. Though the structure 200 is shown throughout FIGS. 16-18 as being a simple cylinder, it should be understood that the structure 200 could include many different structures of various complexity. For example, the structure 200 may include a building, an animal statue, a robot, and a vehicle. One having skill in the art may select any other suitable structure 200 to be built with the construction units 100, as desired.

In operation, the method may include a first step of providing a plurality of the construction units 100, separately, as described hereinabove. In a second step, at least one of the magnetic connectors 108 of a first one of the construction units 100 is connected with at least one of another one of the magnetic connectors 108 of the first one of the construction units 100, and at least one of the magnetic connectors 108 of a second one of the construction units 100, whereby the structure is formed. In other words, the first one of the construction units 100 may connect to itself to form the three-dimensional structure 200, or the first one of the construction units 100 may connect to another one of the construction units 100 to form the three-dimensional structure 200.

It should be understood that the structure 200 can be formed from any number, size, or shape of construction units 100. In the method, the plurality of separate construction units 100 may also be provided to the user in the form of the kit 160.

The method 200 may have a further step of providing at least one active unit 176 and at least one control unit 178, described hereinabove. One of the active unit 176 and the control unit 178 may be disposed on one of the construction units 100. Then the active unit 176 and the control unit 178 may be placed in electrical communication to activate the active unit 176.

Advantageously, the construction unit 100, the kit 160, and the method of the present disclosure can be used in various ways as described hereinabove to easily form or assemble three-dimensional shapes and structures 200. The various components of the kit 160 including the construction unit 100 are flexible and easily connected and disconnected. It has been found that the construction units 100 are entertaining for children and adults and usable as toys.

While certain representative embodiments and details have been shown for purposes of illustrating the invention, it will be apparent to those skilled in the art that various changes may be made without departing from the scope of the disclosure, which is further described in the following appended claims.

What is claimed is:

1. A construction unit, comprising:

a main body formed from a flexible material, the main body having a first side and a second side; and a plurality of magnetic connectors attached to the main body, wherein the main body has a maximum thickness between 0.1 millimeter and 5 millimeters, wherein each of the magnetic connectors has a first portion, a second portion, and a magnet, the first portion disposed adjacent to the first side of the main body and the second portion disposed adjacent to the second side of the main body, the magnet disposed between the first portion and the second portion, and the first portion and the second portion securing the magnet to the main body, and each of the first portion of the magnetic connector and second portion of the magnetic connector has an exterior surface and an interior surface, and an aperture formed therethrough from the exterior surface to the interior surface, and each of the apertures receiving the magnet, and wherein each of the magnetic connectors has a thickness that is greater than the maximum thickness of the main body, and wherein the second portion of the magnetic connector has at least one welding bridge disposed on the interior surface of the second portion, the at least one welding bridge connecting the interior surface of the second portion with the interior surface of the first portion, wherein each of the first portion and the second portion of the magnetic connector is formed from a thermoplastic material and the at least one welding bridge is affixed to the interior surface of the first portion by ultrasonic welding.

2. The construction unit of claim 1, wherein the main body has a plurality of preformed apertures formed therethrough, and at least one of the preformed apertures receives one of the magnetic connectors, the one of the magnetic connectors entirely surrounded by a free end area of the main body.

3. The construction unit of claim 1, wherein the flexible material is selected from a group consisting of paper, synthetic paper, leather, synthetic leather, elastomer, plastic, rubber, metal, fabric, composites, and combinations thereof.

4. The construction unit of claim 1, wherein the main body has four arms extending outwardly from a hub, each of the arms having a free end area, and the plurality of magnetic connectors includes at least four first unit magnetic connectors, each of the first unit magnetic connectors disposed adjacent the free end area of one of the arms, and each of the four arms is disposed on a same plane.

5. The construction unit of claim 1, wherein the first portion has a plurality of first ratchet teeth disposed on the exterior surface around the aperture of the first portion, and the second portion has a plurality of second ratchet teeth disposed on the exterior surface around the aperture of the second portion, wherein the first portion has an annular groove formed in the exterior surface around the aperture of the first portion, and the first ratchet teeth are disposed in the annular groove, and the second ratchet teeth protrude outwardly from the exterior surface of the second portion, and the first ratchet teeth of a first one of the magnetic connectors are configured to cooperate with the second ratchet teeth of a second one of the magnetic connectors.

6. The construction unit of claim 1, wherein the magnet is recessed from the exterior surface of the first portion a first distance, and the magnet is recessed from the exterior surface of the second portion a second distance, and the first distance is greater than the second distance.

7. The construction unit of claim 6, wherein the magnet has a first section and a second section, the first section having a first width and the second section having a second width, and the first width is greater than the second width, the first section of the magnet disposed in the aperture of the first portion of the magnetic connector, and the second section of the magnet disposed in the aperture of the second portion of the magnetic connector.

8. A kit for construction of a structure, comprising:

a plurality of separate construction units, each of the construction units having a main body formed from a flexible material, the main body having a first side and a second side, and a plurality of magnetic connectors attached to the main body, wherein the main body has a maximum thickness between 0.1 millimeter and 5 millimeters; and at least one active unit and at least one control unit, the control unit formed from a printed circuit board and having a battery and a microprocessor, and the active unit and the control unit are each configured to be disposed on one of the magnetic connectors of one of the construction units, whereby the control unit is configured to power the active unit where the active unit is disposed on a magnetic connector.

9. The kit of claim 8, wherein the plurality of separate construction units includes a first unit, the first unit having four arms extending outwardly from a hub, each of the arms having a free end area, and the plurality of magnetic connectors includes at least four first unit magnetic connectors, each of the first unit magnetic connectors disposed adjacent the free end area of one of the arms, and each of the four arms is disposed on a same plane.

10. The kit of claim 9, wherein the plurality of separate construction units includes a second unit, the second unit having an elongate body with free end areas, and the plurality of magnetic connectors includes at least two second unit magnetic connectors, each of the second unit magnetic connectors disposed adjacent one of the free end areas of the elongate body.

11. The kit of claim 10, wherein the plurality of separate construction units includes a third unit, the third unit having a generally ovoid body having a first end and a second end, and the plurality of magnetic connectors includes a third unit magnetic connector, the third unit magnetic connector disposed adjacent the first end of the generally ovoid body.

12. The kit of claim 8, wherein the at least one active unit includes one of a light, a motor, a sensor, and a speaker.

13. The kit of claim 8, wherein the kit further includes at least one flexible link configured to place the active unit in electrical communication with the control unit.

14. A method for construction of a structure, comprising the steps of:

providing a plurality of separate construction units, each of the construction units having a main body formed from a flexible material, the main body having a first side and a second side, and a plurality of magnetic connectors attached to the main body, wherein the main body has a maximum thickness between 0.1 millimeter and 5 millimeters;

providing at least one active unit and at least one control unit, the control unit formed from a printed circuit board and having a battery and a microprocessor, and the active unit and the control unit are each configured to be disposed on one of the magnetic connectors of one of the construction units, whereby the control unit is configured to power the active unit where the active unit is disposed on a magnetic connector; and connecting at least one of the magnetic connectors of a first one of the construction units with at least one of another one of the magnetic connectors of the first one of the construction units, and at least one of the magnetic connectors of a second one of the construction units, whereby the structure is formed.

15. The method of claim 14, wherein the plurality of separate construction units is provided as a kit, wherein the kit includes a first unit, a second unit, and a third unit, the first unit having four arms extending outwardly from a hub, each of the arms having a free end area, and the plurality of magnetic connectors includes at least four first unit magnetic connectors, each of the first unit magnetic connectors disposed adjacent the free end area of one of the arms, and each of the four arms is disposed on a same plane, the second unit having an elongate body with free end areas, and the plurality of magnetic connectors includes at least two second unit magnetic connectors, each of the second unit magnetic connectors disposed adjacent one of the free end areas of the elongate body, and the third unit having a generally ovoid body having a first end and a second end, and the plurality of magnetic connectors includes a third unit magnetic connector, the third unit magnetic connector disposed adjacent the first end of the generally ovoid body.

* * * * *